United States Patent [19]

Davis

[11] 4,337,853

[45] Jul. 6, 1982

[54] COVER FOR LUGGAGE CASE AND METHOD OF MAKING

[75] Inventor: Michael Davis, New Castle, Pa.

[73] Assignee: Airway Industries, Inc., Ellwood City, Pa.

[21] Appl. No.: 192,607

[22] Filed: Sep. 30, 1980

[51] Int. Cl.[3] ..... A45C 5/02

[52] U.S. Cl. ..... 190/53; 112/262.1

[58] Field of Search ..... 190/26, 53, 54, 41 R; 112/262.1

[56] References Cited

U.S. PATENT DOCUMENTS

| | | | |
|---|---|---|---|
| 2,661,823 | 12/1953 | Goetz . | |
| 3,921,768 | 11/1975 | Gorky | 190/26 |
| 4,116,311 | 9/1978 | Davis | 190/54 X |

*Primary Examiner*—Donald F. Norton

*Attorney, Agent, or Firm*—Buell, Blenko, Ziesenheim & Beck

[57] ABSTRACT

A cover for the body and a similar cover for the lid of a luggage case, each of which covers is made up of a number of pieces of sheet material pre-cut so that when the pieces are sewn together the cover assumes a three dimensional form which enables it to be manually fitted over the corresponding body shell and lid shell and fastened in close tight-fitting relation to the shell. The side panels are of relatively thin sheet material and the end areas are constituted by several parallel strips of relatively thick sheet material stitched together and also stitched in overlapping relation to the side panels. The edges of the end strips are sewn together so as to form a projecting rib surrounding the body and the lid for a pleasing appearance and for assuming wear and abrasion of the end of the luggage case. Overall weight of the luggage case is reduced by employing relatively thin sheet material for the major area of coverage and relatively thick sheet material only at the ends of the luggage case.

8 Claims, 6 Drawing Figures

COVER FOR LUGGAGE CASE AND METHOD OF MAKING

This invention relates to a cover for a luggage case having a body shell and one for the lid hinged together, such as an attache case, and to a method of constructing the cover from a number of two-dimension pieces of sheet material, assembled as by stitching them together to provide a three-dimensional form adapted to be installed and fitted manually to the body shell and lid shell.

A principal purpose of my invention is to construct a cover for a two-part hinged luggage case which simulates the appearance of being of relatively thick sheet material throughout but in fact having the major part of the covering material of relatively thin sheet material and only the end areas of relatively thick sheet material.

A further purpose of my invention is to provide a relatively simple manner of construction of a cover for a luggage case which reduces labor cost and which at the same time provides a novel and pleasing appearance for the luggage case.

In the prior U.S. Pat. No. 3,921,768 to Samson Gorky issued Nov. 25, 1975, a method of making a cover for a luggage case is disclosed in which a number of two-dimensional pieces of sheet material are stitched together to provide a three-dimensional form which is capable of being fitted manually over the shells of the body and the lid therefor. In this patent, all the pieces of sheet material are the same thickness and because of the thickness of the sheet material considerable weight is added to the luggage case.

According to my invention, the weight added to the luggage case by the covers fitted over the body and the lid is reduced simply by providing a relatively thin sheet material for the major area of the cover and stitching end sections thereto of thicker sheet material. At the same time the end sections are so stitched together as to cause projecting ribs to be formed surrounding the entire body and lid, which ribs serve the purpose of welting in assuming wear and abrasion on the luggage case. At the same time, the projecting ribs provide a pleasing appearance and a decorative design.

I am aware of U.S. Pat. No. 2,661,823 to E. M. Goetz, issued Dec. 8, 1953, wherein binding strips are stitched to the ends of a cover for a luggage case. Such binding strips, however, serve only to add structural strength to the cover at the point of attachment to the luggage case frame.

More specific details of the structure and method of making my cover for luggage cases are described hereinafter in relation to the accompanying drawings, wherein.

Figure 1:
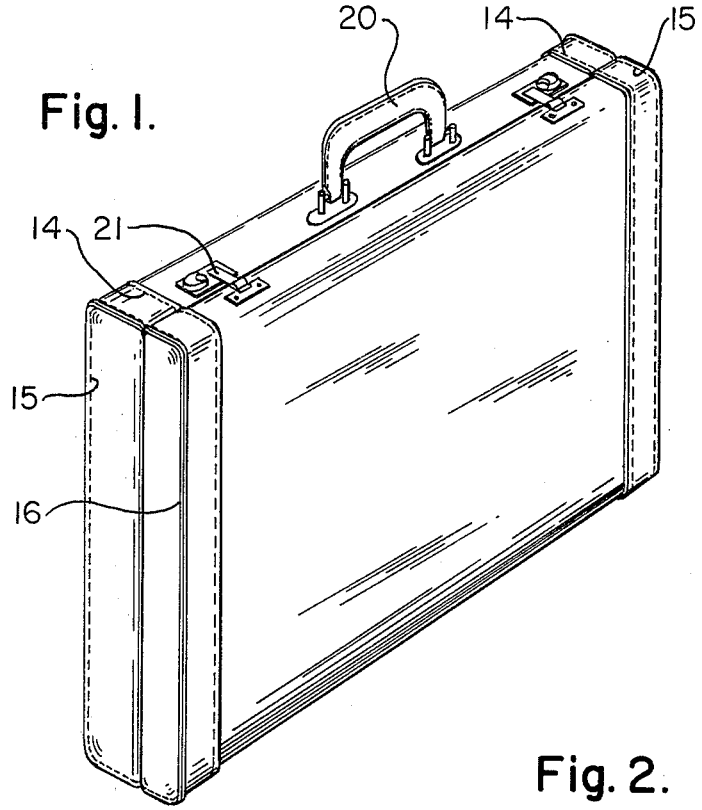
FIG. 1 is an isometric view showing the overall appearance of an attache case having a cover embodying my invention.

Referring to the drawings, it will be seen that I provide a cover 10 for a luggage case, illustrated in FIG. 1 as of the type having two similar dished or box-like shells, one a body shell and the other a lid shell, the two shells being hinged together along one edge so as to be swung into mating relation.

Figure 2:
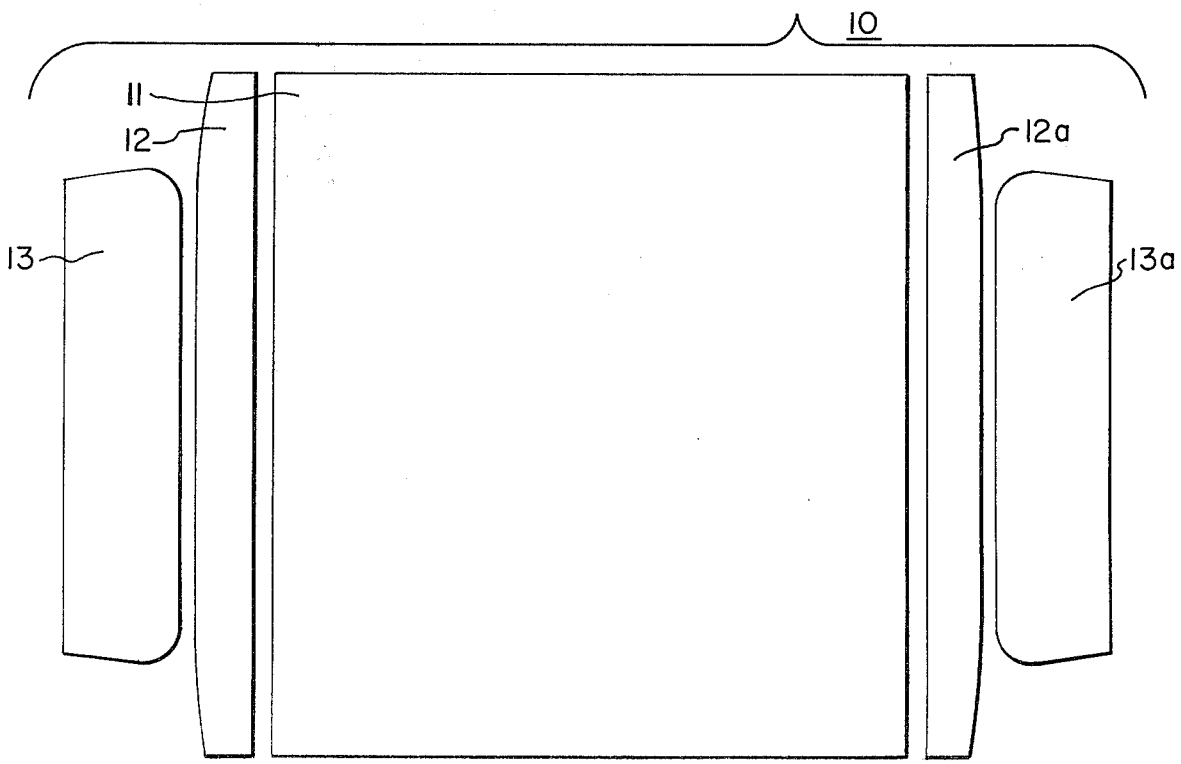
FIG. 2 is a view showing, in a single plane, the number and shape of pieces of sheet material constituting a cover for a shell forming one part of a luggage case.
Figure 3:
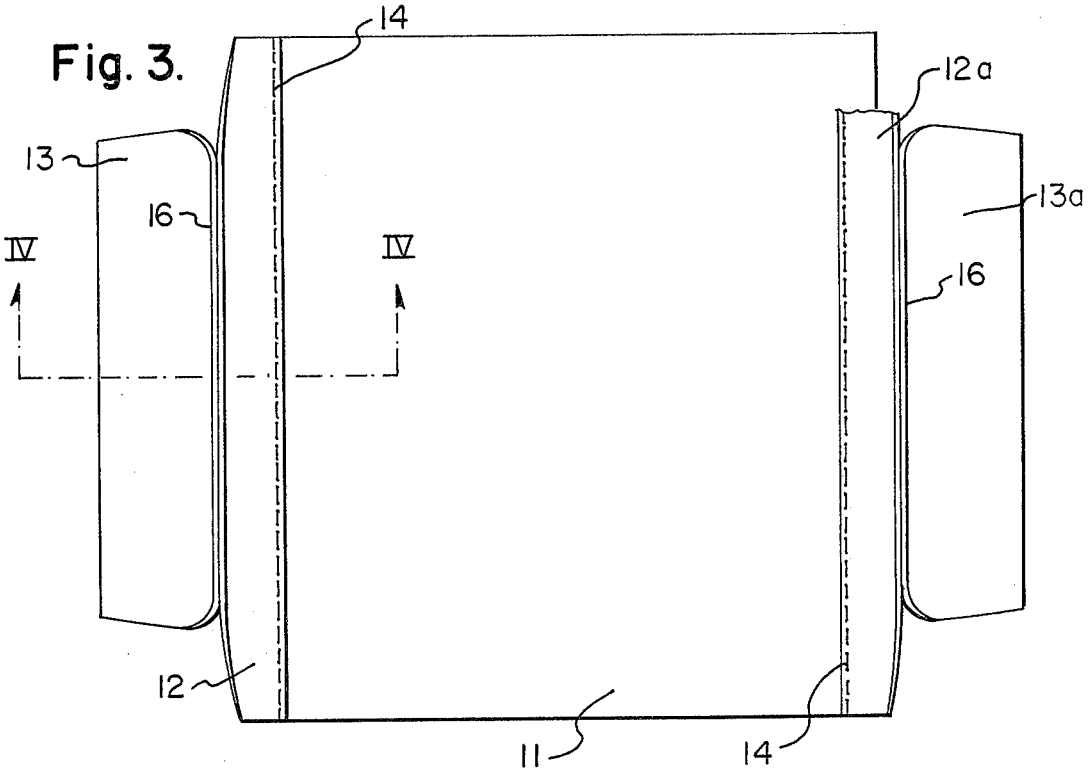
FIG. 3 is a view, showing the appearance of the cover pieces of FIG. 2 after partial assembly.
Figure 4:
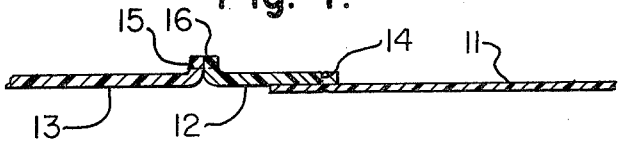
FIG. 4 is a fragmental sectional view, taken on the line IV—IV of FIG. 3 showing in profile the relation of the end pieces, as stitched together, and the greater thickness of sheet material employed by the end pieces in relation to that of the side panels.

As shown in FIGS. 2, 3 and 4, the cover 10 for a single shell, either the body shell or the lid shell, is made up of a total of five pieces of sheet material, consisting of a main or side panel piece 11, two end pieces or strips 12 and 12*a*, and two end pieces 13 and 13*a*. The side panel piece 11 varies in size conformably to the size of the shell to be covered, but is of generally rectangular shape. The end pieces 12 and 12*a* are similar to each other but one is the mirror image of the other. Likewise, the end pieces 13 and 13*a* are generally similar to each other, one being a mirror image of the other.

Figure 6:
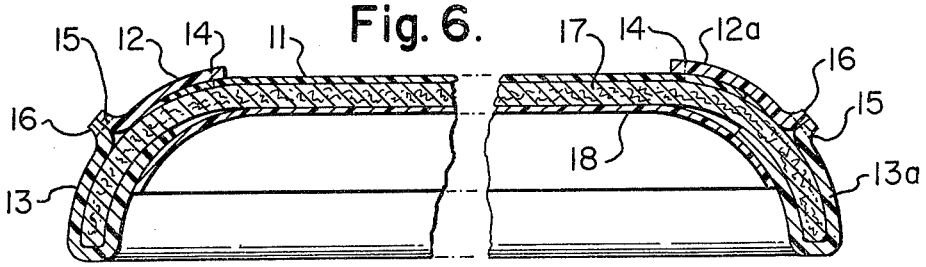
FIG. 6 is a sectional view, on enlarged scale, of a cover as installed on the corresponding shell.

It will be seen that the positioning of the cover pieces in FIG. 2 is such as to indicate generally the manner in which the pieces are moved together for the initial step of assembly. Thus, pieces 12 and 12*a* are moved into overlapping relation to the adjacent margin of the central main piece 11 and stitched together along a line 14 spaced from and paralleling the straight inner edge of the piece 12 or 12*a*. As will be seen in FIGS. 3 and 4, the pieces 12 and 12*a* overlap the opposite edges of the central main piece 11 but not to the extent of the full width of the piece 12 or 12*a*. This is significant as it allows the edges of pieces 13 and 13*a* to be bent up and matched to the outer bent up edge of the pieces 12 and 12*a*, to enable them to be stitched together by a line of stitching 15 extending through the double thickness of the bent up edges, so as to form the decorative ribs 16 (FIGS. 3, 4 and 6). FIG. 4 shows clearly the relative thickness of the central main piece 11 and of the end pieces 12 and 12*a*.

Figure 5:
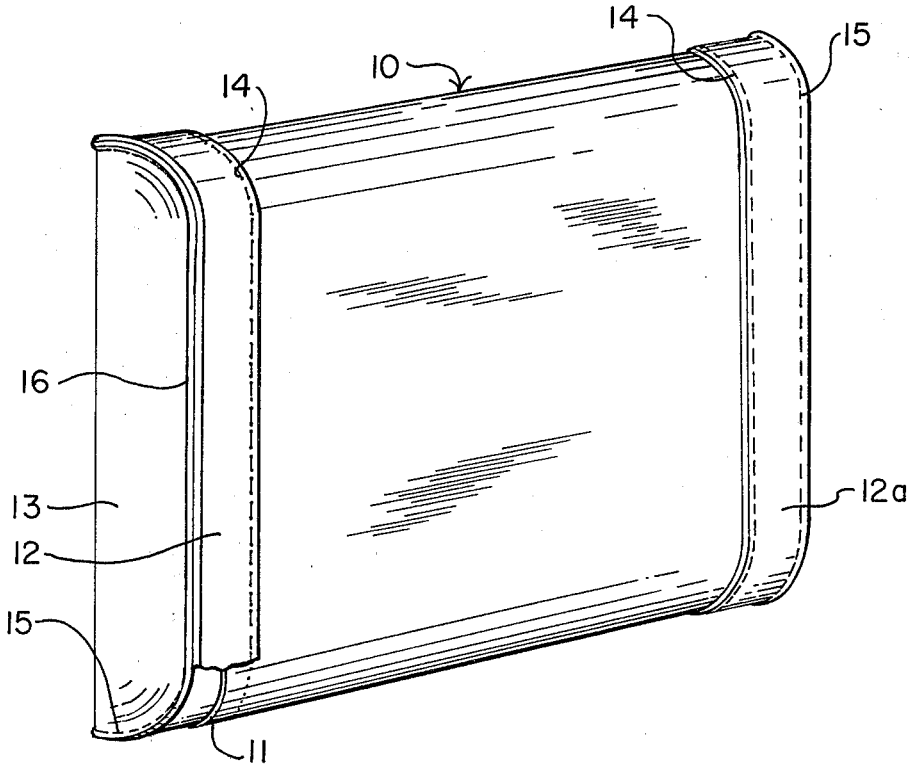
FIG. 5 is an isometric view, showing the appearance of the cover after the final step of assembly and its condition ready for installation or mounting on the shell.

Due to the curvature of the outer edge of pieces 12 and 12*a* and the curvature of the edge of pieces 13 and 13*a*, when the pieces 13 and 13*a* are fully stitched to the pieces 12 and 12*a*, the assembly of the two-dimensional pieces assumes the three-dimensional form of cover 10 as clearly shown in FIG. 5. In this form, the cover 10 is manually fitted over the shell 17, with the peripheral excess of the cover being bent over and back into the interior of the shell and tacked or stapled to the shell, which is of fiber board or similar nature. A lining 18, of textile material is then fitted into the interior of the shell 17 so as to overlap the edges of the end pieces 13 and 13*a*. This provides a decorative inside surface for the body and lid of the luggage case.

The identical procedure is followed to assemble the cover for the body shell and the shell of the lid.

The final steps in the assembly of the luggage case involves attaching various fixtures and fittings such as the hinges (not shown), the handle 20 and the locks 21.

It will be seen that the above described method which I have devised for assembling the various pieces of sheet material into a three-dimensional cover adapted to be manually fitted over the shells of the body and lid provides a relatively simple procedure which reduces the amount of time for the assembly of the cover and consequently the labor cost involved. Any suitable type of sheet material may be employed to make the cover. However, a vinyl sheet material is a good practical material which presents a pleasing appearance and is serviceable. Variations in the contour of the pieces of sheet material may be made depending upon the shape of the shells to which the cover is to be applied.

I claim:

1. A cover for a luggage case of the type having cooperating dished shells hinged along an edge, said cover comprising a main piece of sheet material of generally rectangular shape for one of said shells, and a pair of end strips of sheet material for each of the opposite ends of said main piece, one strip of each pair being shorter in length than the other strip of the pair, the larger strip of each pair of end strips being extended into overlapping relation to the edge of said main piece and secured thereto, the remaining edge of said larger strip of each pair of end strips being matched with one edge of the shorter strip of said pair of end strips and stitched together along one side and around the ends of the shorter strip, said main piece and pairs of end strips in assembled relation providing a three-dimensional dished cover conforming to the exterior surface of one of said shells.

2. A cover for a luggage case of the type having cooperating hinged shells of dished shape, said cover comprising a main piece of sheet material of generally rectangular shape, a first pair of end strips, a second pair of end strips shorter in length than the first pair, the longer strip of each of said first and second pairs being secured in overlapping relation to a corresponding end of said main piece, and the second shorter strip of each pair being matched along one edge to the outer edge of the said one strip and stitched thereto along one side and around the ends of the shorter strip, said main piece and said first and second pairs of end strips when in assembled relation providing a dished cover conforming to the exterior surface of one of said shells.

3. A cover for a luggage case according to claim 2, wherein said main piece of sheet material is relatively thin in relation to the thickness of said end pieces whereby to reduce the overall weight of said cover.

4. A cover for a luggage case of the type having cooperating dished shells hinged along an edge, said cover comprising a main piece of sheet material of generally rectangular shape for one shell and a pair of end strips of sheet material for each of the opposite ends of said main piece, one of the end strips of each pair being extended over the corresponding end of the main piece in overlapping relation and attached thereto by a line of stitching paralleling the edge of the end strip, the remaining edge of said one end strip and one edge of the other strip of each of said pairs being bent up and matched in contour, said end strips being secured together by a line of stitching extending through the bent up portion of the matched edges of the end strips to form a projecting rib, said main piece and end strips in assembled relation forming a cover comformable to the exterior surface of one of said dished shells.

5. A cover for a luggage case, according to claim 4, wherein the perimeter of said assembled main piece and end strip is folded back into the exterior of a shell and attached thereto to hold the cover in tight relation to the exterior surface of the shell.

6. A method of making a cover for a luggage case of the type having two dished shells in hinged relation, comprising the steps of:

(a) providing for one shell a main piece of sheet material of generally rectangular shape,
(b) providing a pair of end strips for each of the opposite ends of said main piece,
(c) disposing one strip of each pair of end strips in overlapping relation to one end of the main piece and securing said one strip to the main piece,
(d) matching the remaining edge of said one strip with one edge of the second one of a pair of end strips,
(e) bending up the matched edges of each said pair of end strips, and
(f) stitching the two end strips together through the bent up edges thereof to form a projecting rib.

7. The method of making a cover for a luggage case of the type having two dished shells in hinged relation, comprising the steps of:

(a) providing for one shell a main piece of sheet material of generally rectangular shape,
(b) providing a pair of end strips for each of the opposite ends of said main piece,
(c) disposing one strip of each pair of end strips in overlapping relation to one end of the main piece and stitching said one end strip to the main piece along a line closely spaced to and paralleling the inner edge of said one end strip,
(d) matching the remaining edge of said one end strip with one edge of the second strip of each said pair of end strips, and
(e) bending up the matched edges of said end strips and stitching the two end strips together through the bent up edges to form a rib.

8. The method of covering a luggage case of the type having two box-shaped shells hinged along an edge, comprising the steps of:

(a) providing for one shell a main piece of covering material in sheet form and of generally rectangular shape,
(b) providing a pair of end strips of covering material in sheet form for each of the opposite ends of said main piece,
(c) disposing one strip of each pair of end strips in overlapping relation to one end of the main piece and stitching said one end strip to the main piece,
(d) matching the remaining edge of said one end strip with one edge of the second strip of each said pair of end strips,
(e) bending up the matched edges of said end strips and stitching the two end strips together through the bent up edges to form a projecting rib,
(f) the said main piece end strips in assembled relation forming a hollow box-like cover,
(g) stretching said cover in tight conformity to the exterior of the corresponding one of said shells,
(h) folding the excess peripheral part of said cover back into the interior of the corresponding shell, and
(i) tacking the excess peripheral part of the cover to the shell.

* * * * *

UNITED STATES PATENT AND TRADEMARK OFFICE

CERTIFICATE OF CORRECTION

PATENT NO. : 4,337,853

DATED : July 6, 1982

INVENTOR(S) : Michael Davis

It is certified that error appears in the above-identified patent and that said Letters Patent is hereby corrected as shown below:

Claim 8, column 4, line 56, "main piece end" should read -- main piece and end --.

Signed and Sealed this

*Seventh* Day of *December 1982*

[SEAL]

*Attest:*

GERALD J. MOSSINGHOFF

*Attesting Officer*

*Commissioner of Patents and Trademarks*